US005530628A

United States Patent [19]

Ngai

[11] Patent Number: 5,530,628

[45] Date of Patent: Jun. 25, 1996

[54] TASK LIGHT

[75] Inventor: Peter Y. Y. Ngai, Alamo, Calif.

[73] Assignee: Peerless Lighting Corporation, Berkeley, Calif.

[21] Appl. No.: 43,392

[22] Filed: Apr. 5, 1993

[51] Int. Cl.[6] ..... F21V 13/00

[52] U.S. Cl. ..... 362/33; 362/127; 362/224; 362/299; 362/300; 362/339; 362/347

[58] Field of Search ..... 362/127, 296, 362/297, 298, 299, 300, 340, 346, 347, 26, 97, 29, 30, 33, 223, 224, 339

[56] References Cited

U.S. PATENT DOCUMENTS

| | | | |
|---|---|---|---|
| 1,902,860 | 3/1933 | Kay et al. | 362/298 |
| 3,160,350 | 12/1964 | Rex et al. | 362/340 |
| 3,679,893 | 7/1972 | Shemitz et al. | 362/345 |
| 4,054,793 | 10/1977 | Shemitz | 362/127 |
| 4,298,916 | 11/1981 | Shemitz | 362/127 |
| 4,300,185 | 11/1981 | Wakamatsu | 362/33 |
| 4,383,289 | 5/1983 | Lewin | 362/297 |
| 4,390,930 | 6/1983 | Herst et al. . | |
| 4,432,044 | 2/1984 | Lautzenheiser | 362/223 |
| 4,434,453 | 2/1984 | Campbell | 362/33 |
| 4,519,019 | 5/1985 | Hall | 362/298 |
| 4,748,543 | 5/1988 | Swarens | 362/347 |
| 4,799,136 | 1/1989 | Molnar | 362/300 |
| 4,939,627 | 7/1990 | Herst et al. . | |
| 5,036,436 | 7/1991 | Rattigan et al. | 362/33 |
| 5,040,104 | 8/1991 | Huisingh et al. | 362/339 |
| 5,079,680 | 1/1992 | Kohn | 362/127 |
| 5,115,380 | 5/1992 | Huisingh et al. | 362/33 |

FOREIGN PATENT DOCUMENTS

| | | | |
|---|---|---|---|
| 888597 | 9/1943 | France | 362/297 |
| 890989 | 9/1953 | Germany | 362/298 |

*Primary Examiner*—James C. Yeung
*Assistant Examiner*—Alan B. Cariaso
*Attorney, Agent, or Firm*—Donald L. Beeson

[57] ABSTRACT

An improved task light is comprised of a housing having a center cavity portion, a light passage opening below the center cavity portion, and an edge cavity for supporting a light source that emits light from the housing's edge cavity portion into its center cavity portion. A reflector, at least a portion of which spans the center cavity portion of the housing and which portion has a proximal and distal edge in relation to the light source, lies along a path that curves inwardly of the housing such that, when the reflector is viewed through the housing's light passage opening from the level of a task surface below the task light and from any position to the front of the task light, the luminance of the spanning portion of the reflector from reflected source light is substantially uniform over substantially the entirety of the spanning portion of the reflector. By maintaining the spanning portion of the reflector at a low luminance level, preferably below approximately 250 footlamberts, the reflector, as an operatively luminous optical element that presents itself to the task area, can be substantially eliminated as a source of reflected glare. In a lens version of the invention, a lens covers the housing's light passage opening and becomes the luminous optical element presented to the task area having a uniform low luminance. The lens can advantageously be used to achieve uniform light distributions within the task area.

37 Claims, 8 Drawing Sheets

| PRISM | DEG. |
|---|---|
| 1 | 76 |
| 2 | 75 |
| 3 | 75 |
| 4 | 74 |
| 5 | 74 |
| 6 | 73 |
| 7 | 73 |
| 8 | 72 |
| 9 | 72 |
| 10 | 71 |
| 11 | 71 |
| 12 | 70 |
| 13 | 69 |
| 14 | 68 |
| 15 | 67 |
| 16 | 66 |
| 17 | 65 |
| 18 | 64 |
| 19 | 63 |
| 20 | 62 |

TASK LIGHT

BACKGROUND OF THE INVENTION

The present invention relates to lighting systems generally, and more particularly to an improved task light for providing substantially glare-free illumination within a task area. The improved task light of the invention is particularly adapted for use with office furniture systems having a task area bounded by at least a backwall and an overhead structure such as a shelf or binder bin under which the task light can be mounted. Other applications of the improved task light of the invention include any application in a large or small architectural environment having task areas that call for task lighting in addition to general ambient lighting.

A poorly lit task area leads to visual discomfort and fatigue that can greatly affect efficiency in completing visual tasks, such as reading and writing. The problem most associated with poor task lighting is reflected glare and veiling reflections, that is, glare that results when the source of the task light is reflected back into the field of view of a person working at the task area from a specular or semi-specular surface or object, such as a desk top, magazine page, or ordinary matte paper. (Reflected glare and veiling reflections will sometime hereinafter be referred to as simply "reflected glare".) Another source of glare is direct glare which occurs when a light source, which may have a surface brightness in the range of 3000 footlamberts as compared to much lower brightness levels on surrounding surfaces (in the range of 100 footlamberts), is within the field of view of the person working at a task. This situation particularly occurs with task lights mounted at a fixed height, such as an under-the-shelf task light. While normally out of view for a person whose eye level is above the task light, the intensely bright source of the task light will often be noticed by a person of short stature with a lower eye level.

Whether the glare is direct or reflected, the result is visual discomfort that is annoying, distracting, and often visually disabling.

Another factor that contributes to the visual comfort of task lighting is the distribution of the light within the task area. It is known that visual comfort in spaces where tasks are performed, such as the office environment, relate to the uniformity of lighting in the space. Office lighting systems, and particular indirect lighting systems, have been devised to increase the overall uniformity of ambient lighting and to decrease contrast brightness on wall surfaces and ceiling surfaces. A difficulty arises, however, when furniture elements, such as office systems furniture, are introduced into the room or architectural space. Such furniture elements typically include partition walls, overhead shelves, binder bins, and the like that creates shadowy areas on task surfaces and in and around the task area. These shadowy areas create visual discomfort, even if they do not cover a visual task. This is because darker shadowy areas contrast with the lighter surrounding areas making it more difficult for the eyes to comfortably adjust to the task lighting environment. Shadows also tend to give the person performing the task the sense of inadequate light. The response to this perceived inadequacy is often to increase the amount of task lighting within the task area. This approach is not only energy inefficient, but also exacerbates problems of reflected glare and veiling reflections.

Heretofore, various task lights have been designed that attempt to increase visual comfort and reduce glare. These prior approaches generally seek to shield the task light from direct viewing, or seek to reduce reflected glare by modifying light distribution patterns. For example, U.S. Pat. No. 5,115,380 issued May 19, 1992 to Huisingh discloses a fixture having a flat lens with a prismatic structure that refracts downwardly light emanating at high viewing angles from the front of the fixture that might otherwise be within the field of view of an adult of normal stature. However, Huisingh does not prevent direct glare at lower viewing angles that occur when eye level is closer to the level of the table top. Thus, the problem of direct glare is not necessarily avoided for people of short stature. Also, because the light source of Huisingh is positioned directly above the lens, the lens will exhibit a hot spot and will be a source of reflected glare. The asymmetry of the prismatic configuration of the Huisingh lens would further create a source of reflected glare by providing areas of contrast brightness across the lens. The only way to eliminate these sources of reflected glare in Huisingh is to reduce the light output of the fixture so that the brightness of the brightest part of the lens is reduced to the point where distracting surface reflections cease to occur. This solution, however, results in an unacceptable trade off: with the reduction in reflected glare, adequate illumination level at the task surface is lost.

Another approach to reducing reflected glare and veiling reflections from a task surface is disclosed in U.S. Pat. No. 4,432,044 issued Feb. 4, 1984, to Terry L. Lautzenheiser. The Lautzenheiser patent discloses a fluorescent task light having a rotatable masking sleeve surrounding the fluorescent lamp. The masking sleeve selectively masks the transmission of light emitted from portions of the lamp so as to reduce veiling reflections as seen from particular positions in front of the work surface. One disadvantage of such an approach is that while veiling reflections may be reduced at particular observation angles, they will not be reduced at others. Thus, if a person sitting in front of a desk or other task surface moves his or her visual task, such as a magazine page, or if the person himself or herself moves in relation to the visual task, then the veiling reflections may reappear requiring an adjustment of the fixture.

Lautzenheiser has other disadvantages. Because it masks only a portion of the lamp's surface, when the masking sleeve is adjusted for optimal control of reflected glare, it leaves exposed areas of lamp brightness that can be a source of direct glare. The exposed bright areas of the lamp are also detrimental to achieving uniform light distribution patterns, particularly on the back wall of a task area.

The present invention overcomes the disadvantages of prior task lights by providing an improved task light that eliminates the source of direct glare from any position in front of the task light, whether the observer's eye level is near the task surface or above the task light. The invention also reduces and can substantially eliminate the source of reflected glare within the task area regardless of the observation angle and without the need to adjust the fixture. The invention further provides for an improved task light and method that eliminates the discomfort associated with visual tasks undertaken in areas which are not uniformly lit and which have various and contrasting areas of brightness. The invention still further provides an improved task light that requires an overall reduced light output to create a comfortably lit task environment, and that is therefore energy efficient.

SUMMARY OF THE INVENTION

Briefly, the invention involves providing a source of task light from an optical element, namely a reflector or lens, having a bottom surface area that presents itself to the task area and that has uniform luminance over the entirety of its presenting surface. The invention further involves providing task light from such an optical element wherein the optical element is operatively maintained at a low luminance level, generally below 250 footlamberts, for most applications. Such a task light will substantially eliminate the source of veiling reflection and reflected glare, and when viewed directly, will not, because of its low luminance, produce direct glare. Furthermore, by distributing the light from a broad and uniformly luminous surface area, a sufficient illumination level is achieved at the task surface to comfortably handle a visual task.

The invention further involves producing task light from an optical means that augments the overhead ambient light to create even illumination in the task area such that all horizontal task surfaces and vertical wall surfaces are substantially uniformly lit, and such that no horizontal or vertical surface will exhibit areas of excessive brightness that contrast with the brightness of other surfaces within the task area, or even with other wall or ceiling surfaces outside the task area when properly lit. The task light of the invention, in its preferred embodiment, acts to evenly illuminate the normally dark back corner of the task area where the horizontal task surface meets the vertical backwall surface, as well as substantial portions of the vertical wall surface itself.

As will be seen from the embodiments hereafter described, the improved task light of the invention is particularly adapted to being mounted in confined spaces with severe height limitations.

The improved task light includes a light source, a housing having a front, rear, top and bottom defining the front, rear, top and bottom of the task light, and a reflector that acts as the luminous optical element presented to the task area. The housing, which is preferably a flat, shallow housing, the height of which is small compared to its breadth, has a center cavity portion, a front cavity portion, a rear cavity portion and a light passage opening below the center cavity portion. The light source, which can be a fluorescent lamp, such as a T8 lamp, is operatively supported in the front edge cavity portion of the housing for emitting light back into the housing's center cavity portion, while the reflector includes a first reflector portion spanning the housing's center cavity portion for receiving source light from the housing's edge cavity portion and for reflecting it down through a bottom light passage opening in the housing subjacent the first reflector portion. The first reflector portion, which has a distal edge and a proximal edge in relation to the light source, extends through the center cavity portion along a path that curves inwardly of the housing. In one aspect of the invention, the curvature of the path on which the first reflector portion lies is chosen such that light from any given light emitting point on the surface of the light source, which is suitably a fluorescent lamp, strikes the proximal edge of the first reflector portion at an angle of incidence that is not substantially smaller, and is preferably greater than the angle of incidence of light from the same point on the surface of the light source which strikes the distal edge of the first reflector portion. In the illustrated embodiment, the angle of incidence of light from a given point on the light source that strikes the first reflector portion does not substantially vary from the reflector portion's proximal edge to its distal edge, with the incident angle at the proximal edge being nominally greater than that at the distal edge. Such a contour and extension of the center cavity reflector in relation to the light source acts to substantially eliminate hot spots at the proximal edge of the reflector that can be a source of reflected glare at the task surface.

In another aspect of the invention, the first reflector portion not only extends and is contoured to eliminate hot spots, but is extended and contoured so that the luminance of the surface of this reflector portion is substantially uniform over the entirety of the presenting surface when viewed from the level of the task surface at any position to the front of the task light. Also, to achieve substantially glare-free illumination in most applications, the luminance presented to the task surface by the task light through the reflector element is preferably operatively maintained at a low luminance level of no more than approximately 250 footlamberts. (The luminance of the reflector should be high enough to provide adequate illumination levels. This will depend on the surface area of the reflector and the illumination levels desired.) A task light fixture with such an optical element efficiently contributes to substantially glare-free lighting by eliminating the source of reflected glare while maximizing the light output of the fixture.

It should be noted that the task light of the invention can be provided with a dimmer switch such that luminance of its optical elements and hence light output can be adjusted to comfortable levels. As noted above, this is done without sacrificing needed light output due to the maintained uniform brightness of the reflector.

It is noted that the first portion of the reflector should be a diffuse or semi-diffuse reflector (suitably a white diffuse reflector), as opposed to a specular reflector. Generally, specularity in the first reflector portion will be detrimental to the object of eliminating areas of excessive brightness on the reflector.

Preferably, the reflector of the invention, in addition to having a first reflector portion spanning the light passage opening, also has a second reflector portion in the front edge cavity of the housing for increasing the efficiency of the lamp, operatively supported in this cavity. The second reflector portion will increase the amount of source light available to the first reflector portion.

Due to the side-by-side relationship of the center cavity reflector and edge cavity light source in the illustrated embodiment of the invention, the invention is uniquely adapted to fit within a shallow, flat housing that can be mounted in a confined space, such as may be encountered in a furniture system where the task light is mounted under a shelf, countertop, or binder bin.

In a further embodiment of the invention, the light passage opening below the center cavity portion of the housing is covered with a light transmissive element, preferably a prismatic lens, having a bottom presenting surface that is the luminous element that presents itself to the task area, instead of the presenting surface of the first portion of the task light's reflector. In accordance with the invention, the light transmissive element receives light reflected from the first reflector portion in such a manner that the luminance of the bottom presenting surface of the transmissive element is substantially uniform over the entirety of its surface. By maintaining the uniform luminance of the light transmissive element to a low luminance level, again below approximately 250 footlamberts, the light transmissive element can be substantially eliminated as a source of reflected glare. The light transmissive element, in turn, can be advantageously used to achieve a desired light distribution within the task area.

In its preferred embodiment, the light transmissive element has two portions: a first light transmissive portion lies subjacent the first reflector portion of the reflector for receiving light reflected from this first reflector portion; a second light transmissive portion extends along the proximal edge of the light transmissive element for receiving and directing source light into the task area directly from the edge cavity portion of the housing. In the illustrated embodiment, the first light transmissive portion takes the form of a planar lens portion having a bottom prismatic surface that generally functions to disperse the light in a distribution pattern that covers much of the task area, including washing a backwall bordering the task area. (The distribution pattern is preferably biased toward to rear of the task light.) The second light transmissive portion in the preferred embodiment takes the form of a prismatic edge lens segment that directs fill light into desired regions below the task light not adequately covered by the first lens portion. The edge lens segment can suitably be used to fill in the normally dark back corner region of the task area where the task surface and backwall surface intersect; it can also contribute to the light on the lower portion of the vertical backwall surface, and the forward portion of the task surface.

Because the edge lens segment of the lens element receives and transmits light directly from the light source, instead of receiving light from the first portion of the reflector, this portion of the lens element is a potential source of reflected glare. Thus, in accordance with the invention, the edge segment of the lens element is provided with masked areas to reduce the effective luminance of its bottom presenting surface. The masked areas preferably take the form of closely spaced masking stripes extending longitudinally of this segment of the lens, and preferably the masking stripes are opaque reflecting stripes that reflect any light not transmitted through the edge lens segment back into the housing so as to increase the available light to the housing's center cavity portion, thereby further increasing the efficiency of the task light. The extent of masking on the edge lens segment is preferably chosen such that the luminance of the bottom presenting surface of this segment is approximately the same as the luminance of the bottom presenting surface of the planar portion of the lens element, thus avoiding substantially luminance variations that produce contrast brightness. Again, in accordance with the method of the invention, the luminance of the entire lens element should be maintained at a low level, preferably below 250 footlamberts.

It is understood that the luminance of the edge segment of the lens element can be controlled by means other than masking the light transmitted through this segment, such as by tinting this segment.

The invention also includes a method for providing task light to a task area bounded by a task surface, an overhead task light mounting structure, such as a shelf or binder bin, and a vertical backwall surface. In accordance with the method, task light provided to the task area is used to augment the ambient lighting in the vicinity of the task area, such as overhead indirect lighting. The method includes the steps of controlling the distribution of the task light such that, including contributions from the ambient lighting, the illumination throughout the task area and on the task surface and vertical backwall surface are substantially uniform. The method also includes providing task light from an optical element having a bottom presenting surface facing the task area, and controlling the luminance of the bottom presenting surface of the optical element such that it is uniform across the element's presenting surface and such that it is sufficiently low that reflected glare and generated on the task surface by the task light is substantially reduced. Preferably, the luminance of the bottom presenting surface of the task light optical element is controlled to within 250 footlamberts.

Therefore, it can be seen that it is a primary object of the present invention to provide a substantially glare-free task light, and a task light that generally improves the overall visual comfort of a person working within an illuminated task area. It is a further object of the invention to provide a task light that can be mounted in confined spaces. Other objects of the invention will be apparent from the following specifications and claims.

DETAILED DESCRIPTION OF THE ILLUSTRATED EMBODIMENT

Before describing the illustrated embodiment, the following definitions should be noted: reference herein to "brightness" means a subjective sensation of brightness; "luminance" means measurable photometric brightness, normally expressed in footlamberts. Reference to luminance of a surface or surfaces as being "uniform" means that, for the surface or surfaces in question, the ratio of maximum luminance to minimum luminance is no greater than approximately 2.5:1. Reference to the distribution of light along horizontal and vertical wall surfaces as being "uniform" shall mean the ratio of the maximum light flux (in footcandles) to the minimum light flux at a given surface shall be no greater than approximately 1.5:1 for horizontal surfaces and no greater than approximately 2.5:1 for vertical surfaces, as measured along a line on such surfaces that falls within a vertical plane that bisects the task light.

Figure 1:
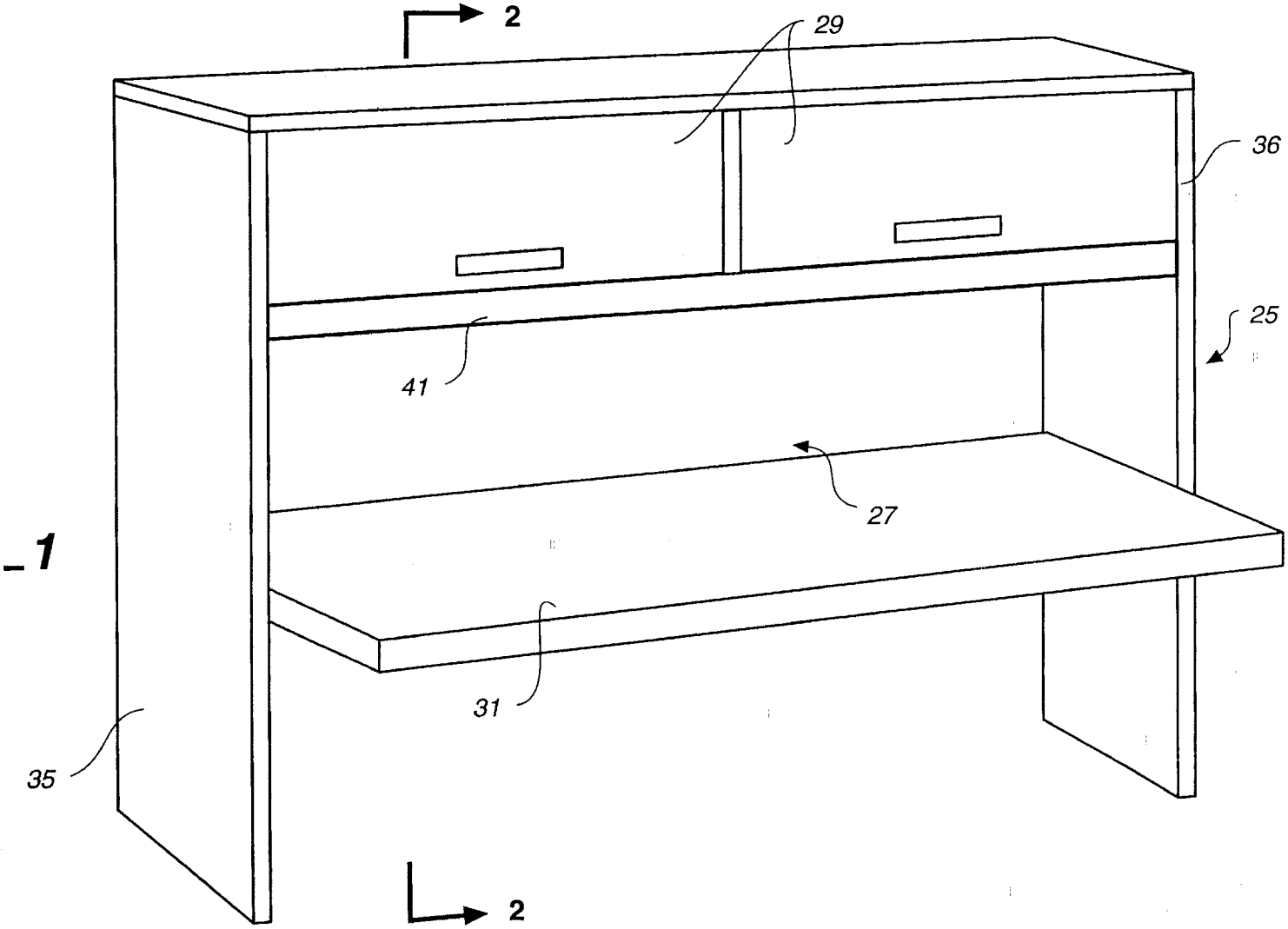
FIG. 1 is a perspective view of a work station having a task area and overhead binder bins to which the improved task light of the invention is mounted.
Figure 2:
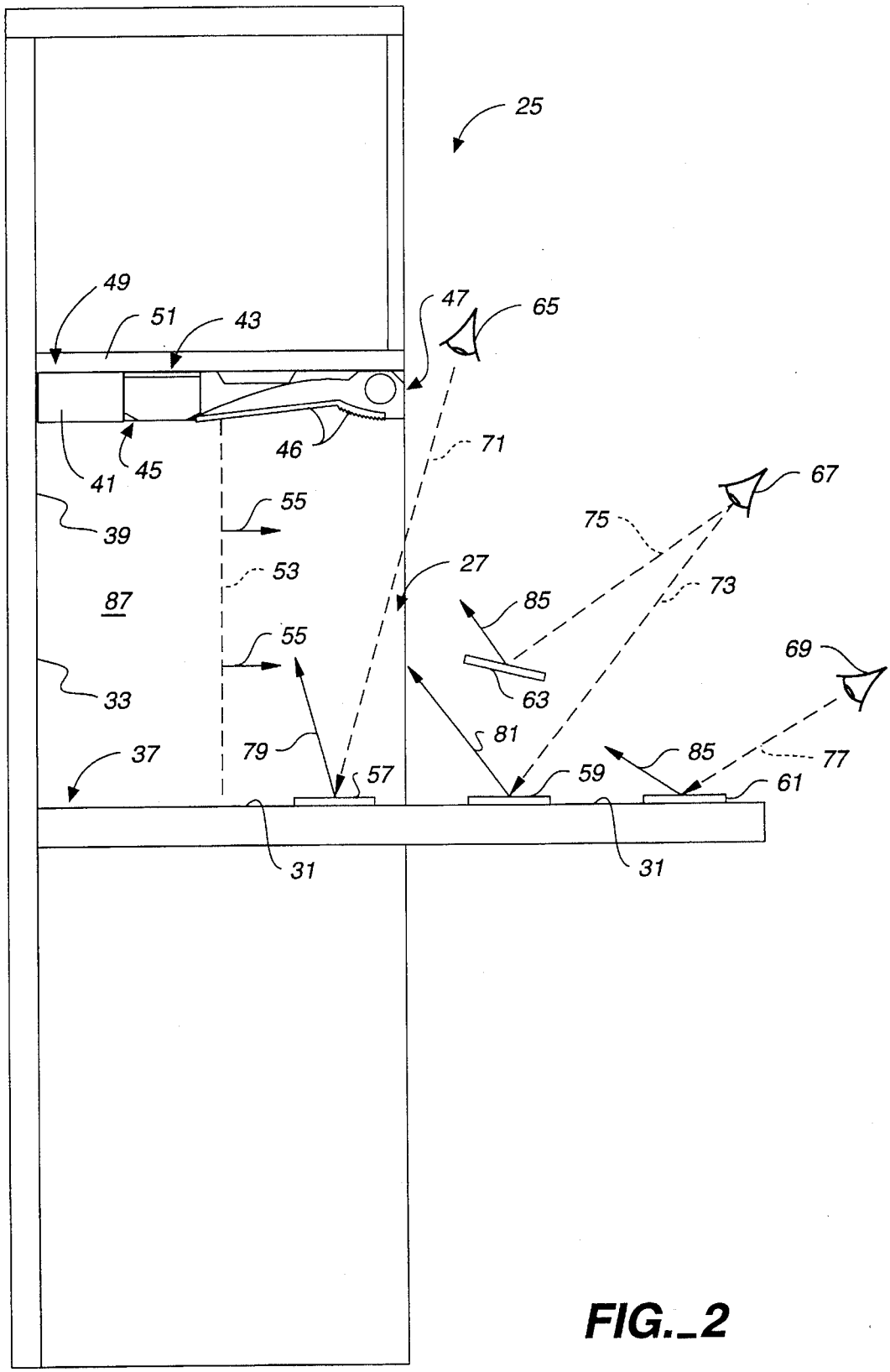
FIG. 2 is a side elevational view in cross-section of the work station shown in FIG. 2 taken along lines 2—2 thereof.

Referring now to the drawings, FIGS. 1 and 2 illustrate a work station 25 having a task area 27 and two binder bins 29 over the task area. The task area is generally defined by the horizontal task surface 31, a vertical backwall 33, two opposite vertical side walls 35, 36, and an overhead panel structure 51 that forms the bottom of the binder bins. A task light 41 having a defined top 43, bottom 45, front 47, and rear 49 is mounted to the bottom panel structure of the binder bins such that the bottom 45 of the task light faces the task surface 31, and such that the front 47 of the task light faces to the front of the work station.

It is noted that the intersection of the horizontal task surface 31 and vertical backwall 33 forms a back corner region 37 of the task area that, along with the upper region 39 of the vertical wall, tends to be shielded from ambient light within the room in which the work station is situated. The extent of the shadows will depend on the ambient lighting and its position relative to the work station. The worst case condition occurs when the source of ambient lighting around the work station is directly over the work station such that the cut off of ambient lighting by the binder bins is most pronounced.

The potential for reflected glare from the task light normally occurs in the part of the task area 27 located to the front of the task light as indicated in FIG. 2 by phantom line 53 and arrows 55. Reflected glare can come from the task surface itself or from the object of a visual task such as a magazine page, writing paper or the like. As shown in FIG. 2, the objects of a visual task may be flat on the task surface, such as objects 57, 59, 61, or held at an angle above the task surface, such as object 63.

Reflected glare, if any, can also be perceived at various observation angles as denoted by eye locations 65, 67, 69, so long as the bottom luminous surface 46 of the task light that presents itself to the task area is within the reflected line of sight of the observer as variously denoted by primary observation arrows 71, 73, 75, 77. Thus, the brightness characteristics of the optical elements of the task light, as described in more detail below, are generally viewed from the level of the task surface from viewing angles to the front of the task light as shown by secondary observation arrows 79, 81, 83, 85. It should be noted, however, that occasionally a visual task may be performed in the back region 87 of the task area to the rear of the task light in a manner that could give rise to reflected glare, such as a situation involving a short work surface where the object subject to the visual task, such as a magazine page, is tilted toward the front of the task area. Therefore, it is desirable, though not required by the task light of the invention, to eliminate potential source of reflected glare from this region as well.

Figure 3:
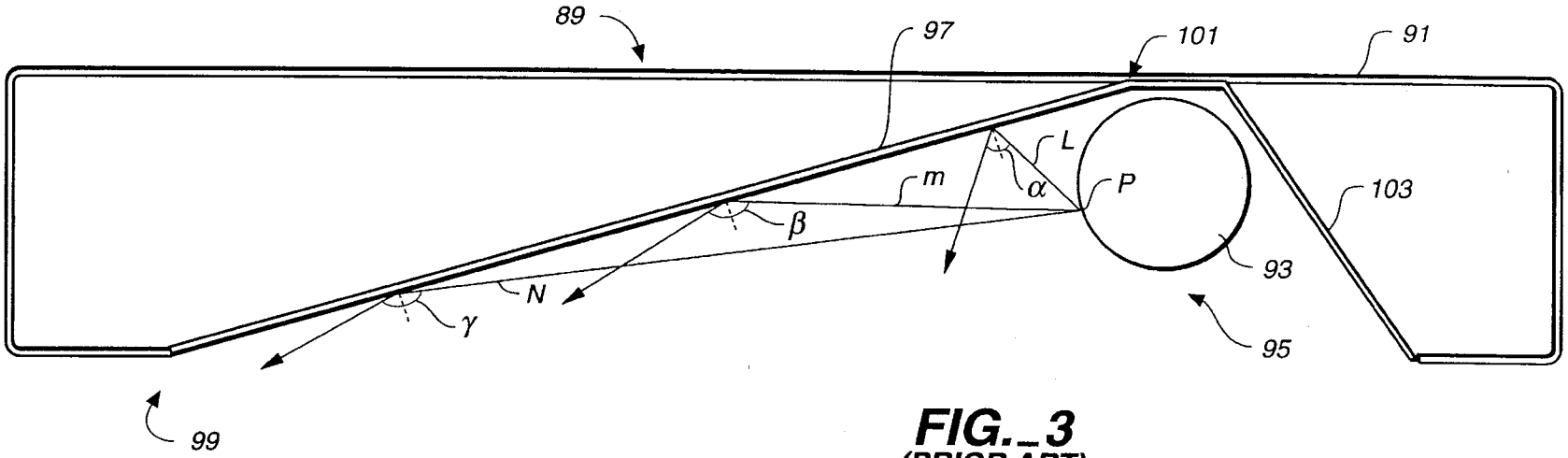
FIG. 3 (PRIOR ART)
FIG. 3 is a side elevational view in cross-section of a prior art task light showing a conventional reflector design and the angle of incidence of source light at different points on the reflector.
Figure 4:
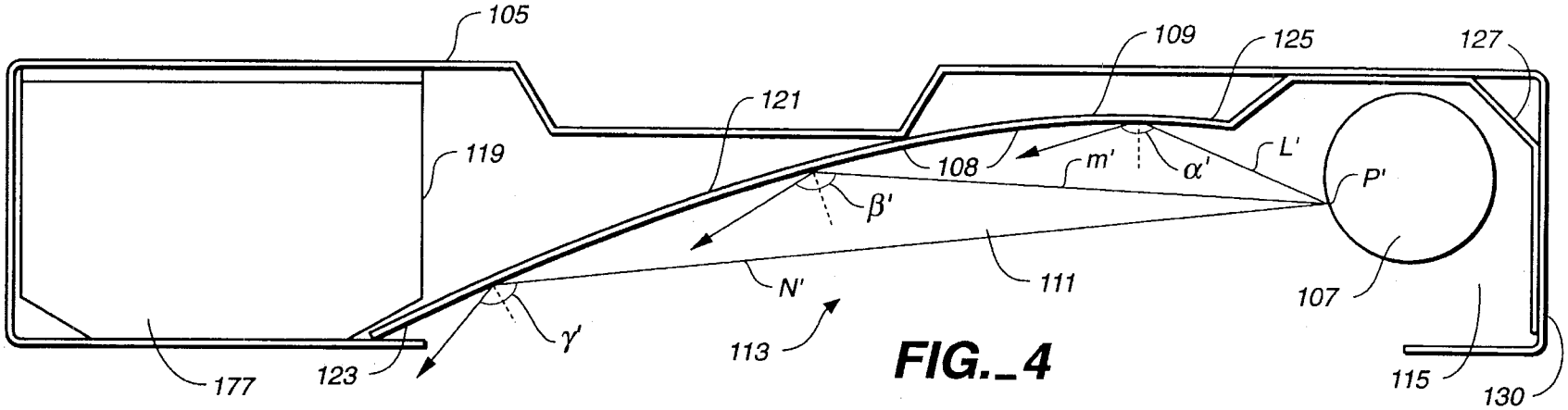
FIG. 4 is a side elevational view in cross-section of a lenseless version of the improved task light of the present invention showing the angle of incidence of source light at different points on the reflector to provide a comparison with the task light of FIG. 3.

FIGS. 3 and 4 provide a comparison of the operative reflecting characteristics of a reflector of a conventional task light fixture (FIG. 3) and a reflector in accordance with the task of the invention. FIG. 3 illustrates a prior art task light fixture 83 of the type heretofore mounted under the counter or binder bins of office systems furniture. The prior art fixture of FIG. 3 is generally depicted as having a flat, shallow housing 91, a linear light source 93 in the form of a fluorescent tube disposed in the housing toward the front of the fixture, a bottom light passage opening 95, and a reflector 97 for reflecting source light through the bottom light passage opening into the task area below the fixture. The reflector of the FIG. 3 prior art task light is further seen to extend in the relatively gradual inclined plane from near the bottom rear edge of the housing at 99 to a position 101 at the top of the housing over the light source. A second reflector portion 103 extends downwardly in a relatively steep inclined plane in front of the light source.

Referring to FIG. 4, the task light of the invention similarly includes a flat, shallow housing. 105, linear light source 107, and reflector 109, suitably formed of bent sheet metal. The housing of the task light shown in FIG. 4 can generally be seen to have a center cavity portion 111, a light passage opening 113 below the center cavity portion, a front edge cavity portion 115 in which the light source is supported for emitting light into center cavity portion 111, and a rear edge cavity portion 117 which houses a ballast 119. The reflector of the task light of the invention, however, differs from the reflector of the prior art task light, in that, its first reflector portion 121, which includes a distal edge 123 and a proximal edge 125 in relation to the light source, and which spans the center cavity of the housing, extends along a path that curves inwardly of the housing so as to increase the angle of incidence of source light that strikes the proximal edge 125 of the reflector from the housing's edge cavity. This in turn, reduces the tendency of the edge of the first reflector portion which is closest to the light source to produce hot spots that can be a source of reflected glare.

The differing characteristics of the reflectors of the FIG. 3 and of FIG. 4 task lights are best illustrated in reference to ray traces L, M, N and L', M', N' shown in these figures. For the prior task light (FIG. 3), the rays L, M, N emitted from Point P on the surface of lamp 93 strike the surface of the first reflector portion at angles of incidence $\alpha$, $\beta$ and $\delta$. It is seen that the angle of incidence $\alpha$ of ray L striking the proximal edge of the first reflector portion is substantially smaller than the angle of incidence $\delta$ of ray N striking the distal edge. The incident angles of rays L, M, N, as they reach further toward the distal edge of the first reflector portion, generally satisfy the following relationship: $\alpha<\beta<\delta$.

By contrast, in the task light of the invention, ray L', M', N' emitted from point P' on the surface of lamp 107 strike the first reflector portion at angles of incidence $\alpha'$, $\beta'$ and $\delta'$ in which angle $\alpha'$ (at the proximal edge) is substantially increased in comparison to angle $\delta'$ (at the distal edge): in FIG. 4 the angle of incidence of light striking the edge of the first reflector portion nearest the light source is nominally greater, and importantly is not substantially smaller than, the incident angle of light striking the edge furthest from the source. It is understood that the incident angle $\alpha'$ may in certain circumstances preferably be substantially greater than incident angle $\delta'$, such as in the case of a wide reflector where the distance between the proximal edge and distal edge of the reflector is relatively large.

It is noted that the ray traces illustrating the incident angles of source light striking the reflectors of the task lights shown in FIGS. 3 and 4 indicate a specular reflection. This, however, is done for illustrative purposes only, and it shall be understood that in accordance with the invention the first reflector portion, and preferably the entire reflector, has a diffuse or semi-diffuse surface, such as a white diffuse reflector surface. Suitably, the reflector surface can be provided with a white enamel finish having a minimum reflectance of approximately 84%.

With further reference to FIG. 4, it can be seen that in the illustrated embodiment the task light is housed in a relatively compact, shallow housing that advantageously can fit into confined mounting environments. In such a shallow housing, the first reflector portion 121 extends along a path that not only curves inwardly of the housing, but if projected at its proximal edge, actually intersects linear light source 107. It is understood, however, that if the configuration of the housing changes, for example, if the task light is housed in a larger, relatively deep housing, or a non-linear light source is used, it may be possible to place the reflector in other orientations relative to the light source so long as the angle at which the light strikes the edge of the presenting reflector surface that is proximal the light source is controlled in relation to the incident angle of source light striking other parts of the reflector.

By controlling the angle of incidence of the source light striking the first portion of the reflector and by using a diffuse or semi-diffuse reflector having uniform reflectance characteristics over its entire surface, the reflector will present to the task area, and particularly to the task area to the front of the task light, a bottom presenting reflector surface 108 that is substantially uniform in photometric brightness (luminance). By controlling the intensity of the source light and the angle of incidence of source light on the first reflector portion, the level of luminance of the presenting surface of the first reflector portion can be controlled.

In accordance with the invention, the luminance level of the first reflector portion is controlled to a low luminance level, preferably below 250 footlamberts. Such a uniformly lit, low brightness reflector surface means that the entire surface of the reflector is actively and substantially equally contributing to the illumination of the task and vertical backwall surface. At the same time, no one area of the reflector surface provides a source of reflected glare due to the fact that no one area is brighter than any other area of the reflector surface.

It should be noted that the first reflector portion could be alternatively constructed in accordance with the invention to provide uniform brightness from the distal edge to the proximal edge of the first reflector portion without the first reflector portion meeting the above-described criteria in respect to the incident angle of source light striking the reflector. Uniform luminance could otherwise be achieved by varying the reflectance characteristics of the first reflector portion within certain areas of the reflector, such as by providing the proximal edge of the first reflector portion with a reflecting surface having relatively low reflectance as compared to the reflectance of the reflecting surface at the distal edge of the first reflector portion. In such a case, the proximal edge of the first reflector portion could be opened up somewhat such that the angle of incidence of source light on the reflector becomes smaller, and even substantially smaller than the angle of incidence of source light from the same point on the light source that strikes the distal edge of the first reflector portion, so long as the uniformity of the luminance of the first reflector portion is maintained. Such an alternative design is intended to be within the scope of the invention, however, such a design would generally be more costly to manufacture and would be less efficient.

A second reflector portion 127 is disposed in the front edge cavity portion of the housing. The reflector portion generally extends around the light source such that light emitted by the back surfaces of the light source are reflected back in the direction of the housing's center cavity portion. This second reflector portion, which preferably is the continuation of the preferably white diffuse first reflector portion 121, includes a top wall section 129, a downwardly extending front wall section 131, and inclined transition walls 133, 135.

Figure 5:
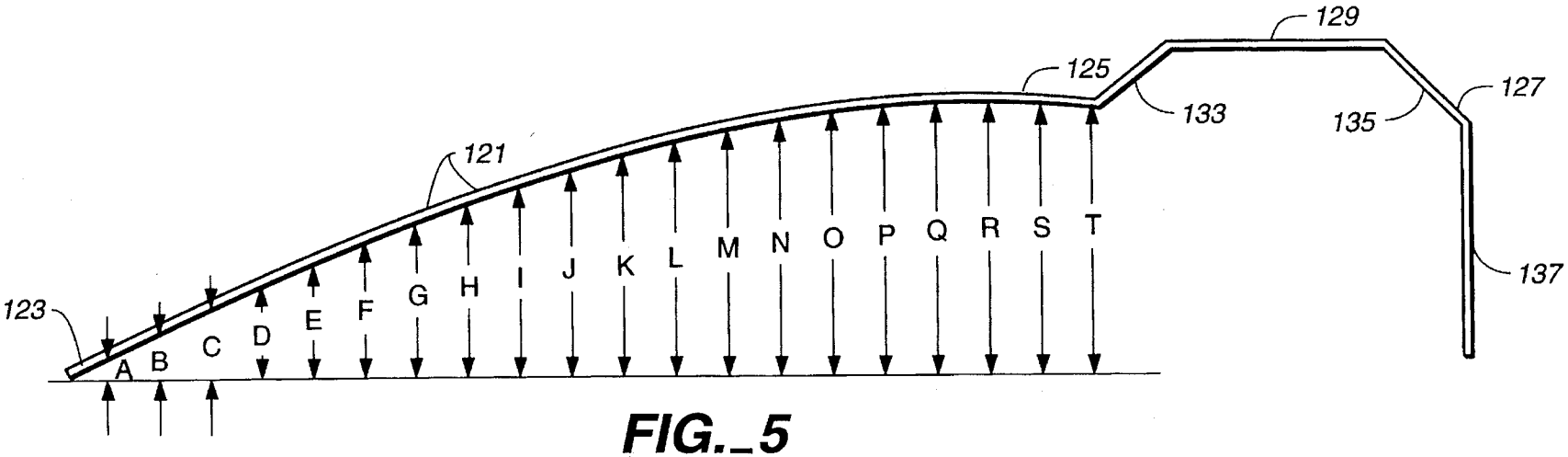
FIG. 5 is a side elevational view of the reflector for the improved task light shown in FIG. 4.

With reference to FIGS. 4 and 5, the following suitable dimensions for the curvature of the first reflector portion can be used to achieve substantially uniform luminance on the presenting reflector surface 108 of the first reflector portion from a T8 lamp supported within the front edge cavity of the task light housing: for a first reflector portion having an overall width of 5.00 inches as measured from its distal edge 123 to its proximal edge 125, the distance between the horizontal and the presenting reflector surface can suitably vary at intervals 0.250 inches apart and designated A through T in FIG. 5, in accordance with the following table:

TABLE

| Interval | A | B | C | D | E | F | G |
|---|---|---|---|---|---|---|---|
| Distance | .122 | .232 | .339 | .443 | .540 | .635 | .730 |
| Interval | H | I | J | K | L | M | N |
| Distance | .821 | .900 | .978 | 1.046 | 1.108 | 1.166 | 1.210 |
| Interval | O | P | Q | R | S | T | |
| Distance | 1.244 | 1.271 | 1.280 | 1.294 | 1.290 | 1.275 | |

The T8 lamp 107, which is one inch in diameter, is preferably supported in the front edge cavity 115 as far forward and as high as practical, that is, as close as practical to the front and top wall sections 129, 131 of the second reflector portion. Suitably, the task light housing 105 can have the height of 1.65 inches and the front edge cavity portion 115 of the housing can have a width of 1.84 inches as measured from the proximal edge 125 of the first reflector portion to the front wall section 130 of the housing. Suitable positioning of the T8 lamp in the front edge cavity would be a lamp centered 0.80 inches from the front wall of the housing and 0.65 inches from the top wall of the housing. It is understood that the above dimensional characteristics of a suitable reflector design and lamp position are illustrative only.

Figure 6:
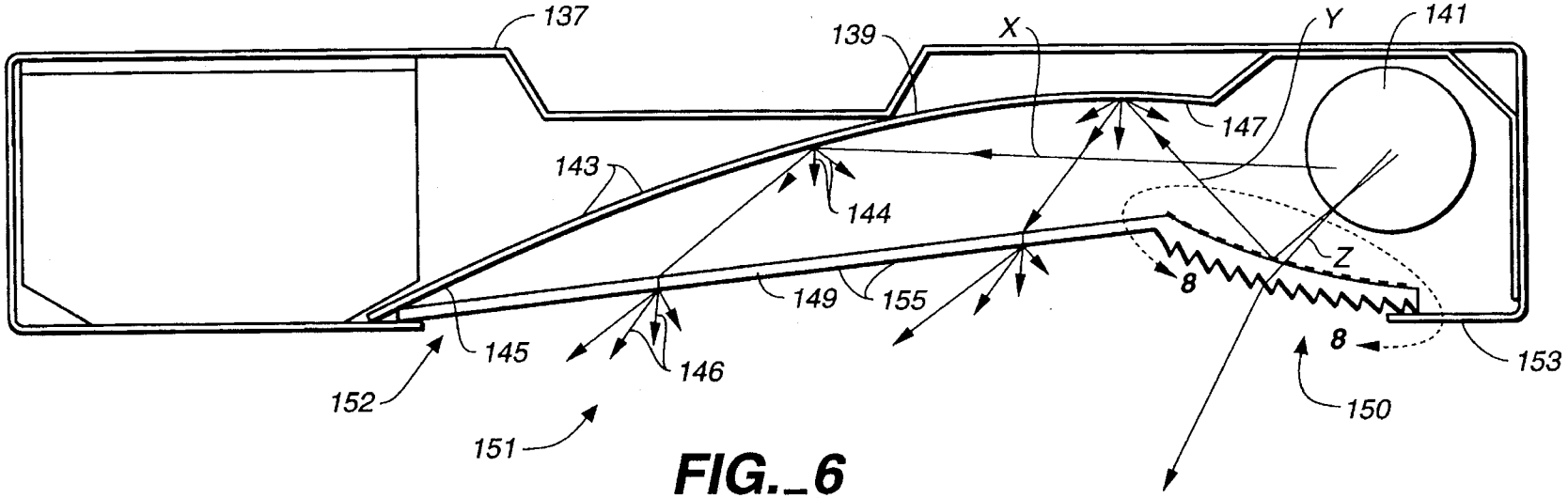
FIG. 6 is a side elevational view in cross-section of a lensed version of an improved task light in accordance with the invention, showing ray traces for light emitted from different points on the light source as it travels through different portions of the task light's lens element.

FIG. 6 illustrates a lensed version of the task light of the invention, and FIGS. 7, 8, 8A and 8B illustrate the detail of the prismatic structure of the lens element of the task light shown in FIG. 6.

Referring to FIG. 6, the lensed version of the task light, like the lenseless version, includes a housing 137, reflector 139 and light source 141, with the reflector being positioned and formed in a manner identical to the reflector described in connection with the lenseless version of the invention illustrated in FIG. 4. In other words, the reflector has a first reflector portion 143, suitably having a white diffuse reflector surface, that spans the center cavity portion of the housing over the housing's bottom light passage opening. The reflector extends from its distal edge 145 to its proximal edge 147 along a path that curves inwardly of the housing such that the reflection characteristics of the first reflector portion are the same as those of the first reflector portion described in connection with FIG. 4 embodiment.

In the FIG. 6 embodiment, a light transmissive element, which is in the form of a prismatic lens element 149, covers the housing's bottom light passage opening 151, thus adding an extra optical element to the optical means of the task light. It is seen that the front bottom wall extension 153 of the housing is sufficiently short to allow the light passage opening to extend somewhat below the light source.

It can further be seen that, in the FIG. 6 embodiment, the lens element 149, instead of a reflector surface, is now the operatively luminous optical element that presents itself to the task area and that now provides a potential source of reflected glare. In accordance with the invention, the luminance of the bottom presenting surface 155 of this lens element is controlled such that its luminance is substantially uniform over the entirety of its bottom presenting surface and such that its luminance is maintained at a relatively low level, preferably below 250 footlamberts. Thus, as with the lenseless version of the invention, by presenting a uniform, low brightness luminous optical element to the task area, the source of reflected glare will be substantially eliminated.

The lens element 149 has a proximal edge 150 and distal edge 152 in relation to the light source and is comprised of two distinct functional portions: a first light transmissive portion in the form of a planar lens portion 157 having a bottom light dispersing prismatic surface 159, and a second light transmissive portion in the form of an edge lens segment 161 having a bottom light directive prismatic surface 163. Both the bottom surfaces 159, 163 of the planar lens portion 157 and edge lens segment 161 are luminous presenting surfaces facing the task area and therefore the luminance characteristics of both are of concern. The luminance of the planar lens portion as viewed from any position to the front of the task light will be controlled substantially entirely by the first reflector portion 143 which itself has a uniform low luminance. This is not true, however, with respect to the edge lens segment, the luminance of which is governed by the intense luminance of the light source. Accordingly, to mitigate the brightness of the edge lens segment, this segment is provided with intermittent masked areas (see FIG. 8) in the form of closely spaced masking stripes 165 running longitudinally along the interior surface of the-edge lens segment. The degree of masking is chosen to prevent the brightness of the edge lens segment from being substantially greater than the planar lens portion when viewed from the task level at any position to the front of the task light. Preferably the luminance of the two lens portions is roughly the same.

It shall be understood that instead of a lens element, some other light transmissive element could be used to cover the bottom light passage opening 151 of the task light of FIG. 6. For example, all or a portion of the light transmissive element might be comprised of a diffuser. Indeed, the diffusing portion of the lens might be tinted, as required, to achieve the desired uniform and low luminance on the bottom presenting surface 155 of the light transmissive element. However, using a diffusing light transmissive element would have the disadvantage of not providing control over the light distribution characteristics of the task light, in the manner described below in connection with the prismatic lens element.

Referring to FIGS. 6–9, the prismatic surfaces 159,163 of the lens element 149 are designed to achieve a desired light distribution in a task area, such as the task area 27 illustrated in FIGS. 1 and 2 bounded by a task surface 31 and a vertical backwall surface 33. Specifically,, prismatic surface 159 on the planar lens portion 157 is comprised of light dispersive, isosceles prisms, that is, prisms having two equal sides, for producing a distribution of light from this portion of the lens element which contributes to the even illumination of both task surface 31 and backwall surface 33. As best illustrated in FIGS. 7A and 7B, the isosceles prisms of the planar lens portion have defined apex angles 167 that preferably increases from the proximal edge 169 of the planar lens portion to its distal edge 171. As shown in FIGS. 7A and 7B, the apex angle starts at 90° at the proximal edge, and preferably increases in 1° increments to a full 180° near the distal edge. Thus, the prisms disappear toward the distal edge of the planar lens portion thereby allowing the lens to relinquish control of the light passing through that lens at this edge. This construction of the planar lens portion effectively biases its light distribution characteristics toward the backwall surface, thereby providing greater illumination to this surface as required to produce substantially uniform illumination of the backwall surface. Without this varying prism pattern, it is found that the illumination of the backwall surface tends to be striated in the mid regions of the backwall. Again, it is noted that the illumination of the backwall surface will fall off somewhat at the upper regions 39 of the surface closest to the task light (see FIG. 2), but it will still generally meet the above defined uniformity criteria for vertical wall illumination of 2.5:1.

The edge lens segment 161.of the lens element, working in concert with the planar lens portion 149, produces a light distribution that fills desired regions below the task light. This lens segment can advantageously be used to fill the back corner region 37 (see FIG. 2) of the task area that is furthest from the task light and that ordinarily is relatively dark.

Figure 7:
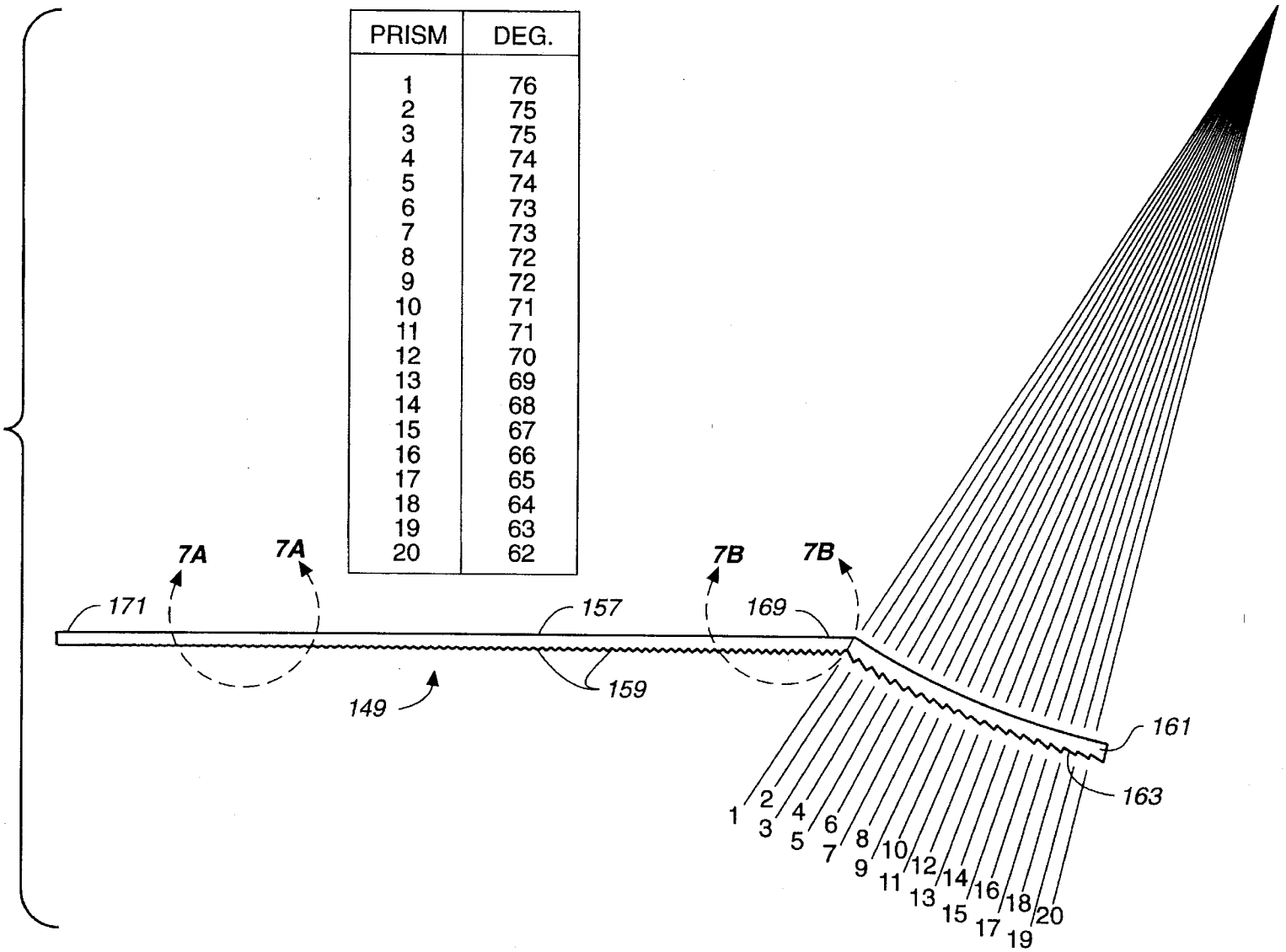
FIG. 7 is a side elevational view of the lens element of the task light shown in FIG. 6 illustrating the overall prism structure of the lens element.
Figure 7A:
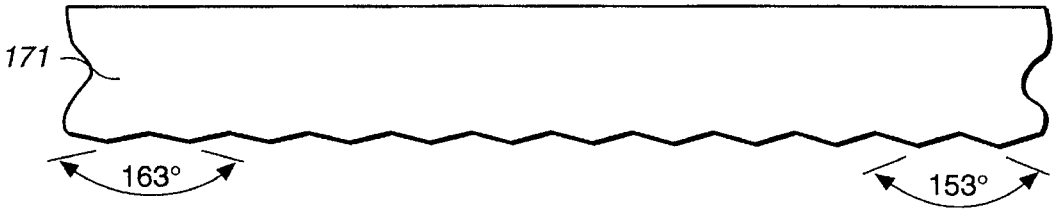
FIG. 7A shows an exploded partial side elevational view of the distal edge of the planer lens portion of the lens element shown in FIG. 7 as indicated by section line 7A—7A.
Figure 7B:
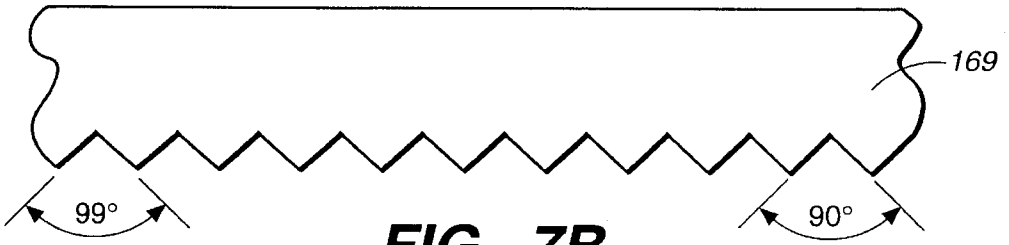
FIG. 7B is a partial cross-sectional view in side elevation of the proximal edge of the planar lens portion of the lens element shown in FIG. 7, as indicated by section line 7B—7B.
Figure 8:
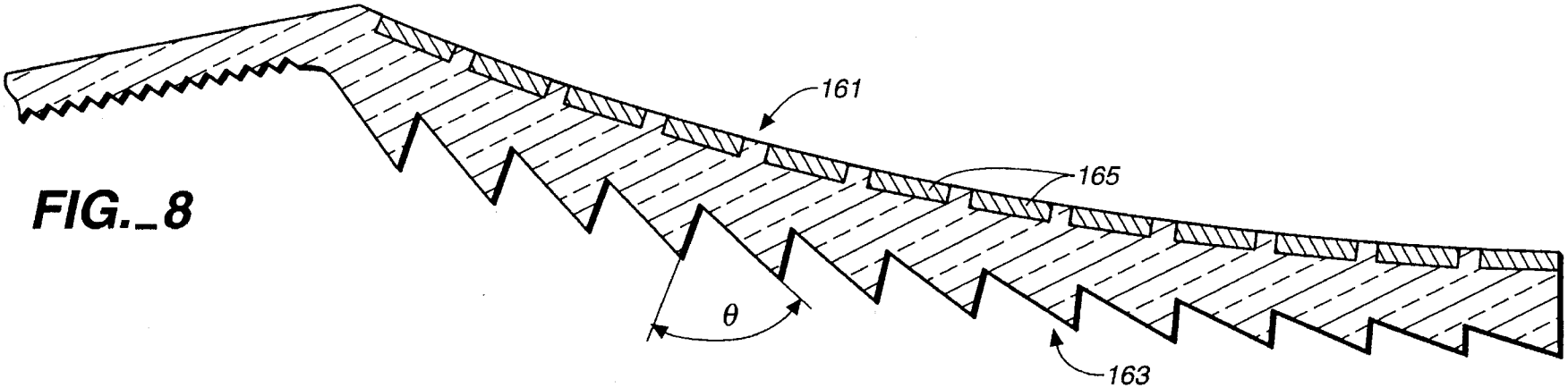
FIG. 8 is an exploded cross-sectional view in side elevation of the edge lens segment of the lens element of task light shown in FIG. 7.
Figure 9:
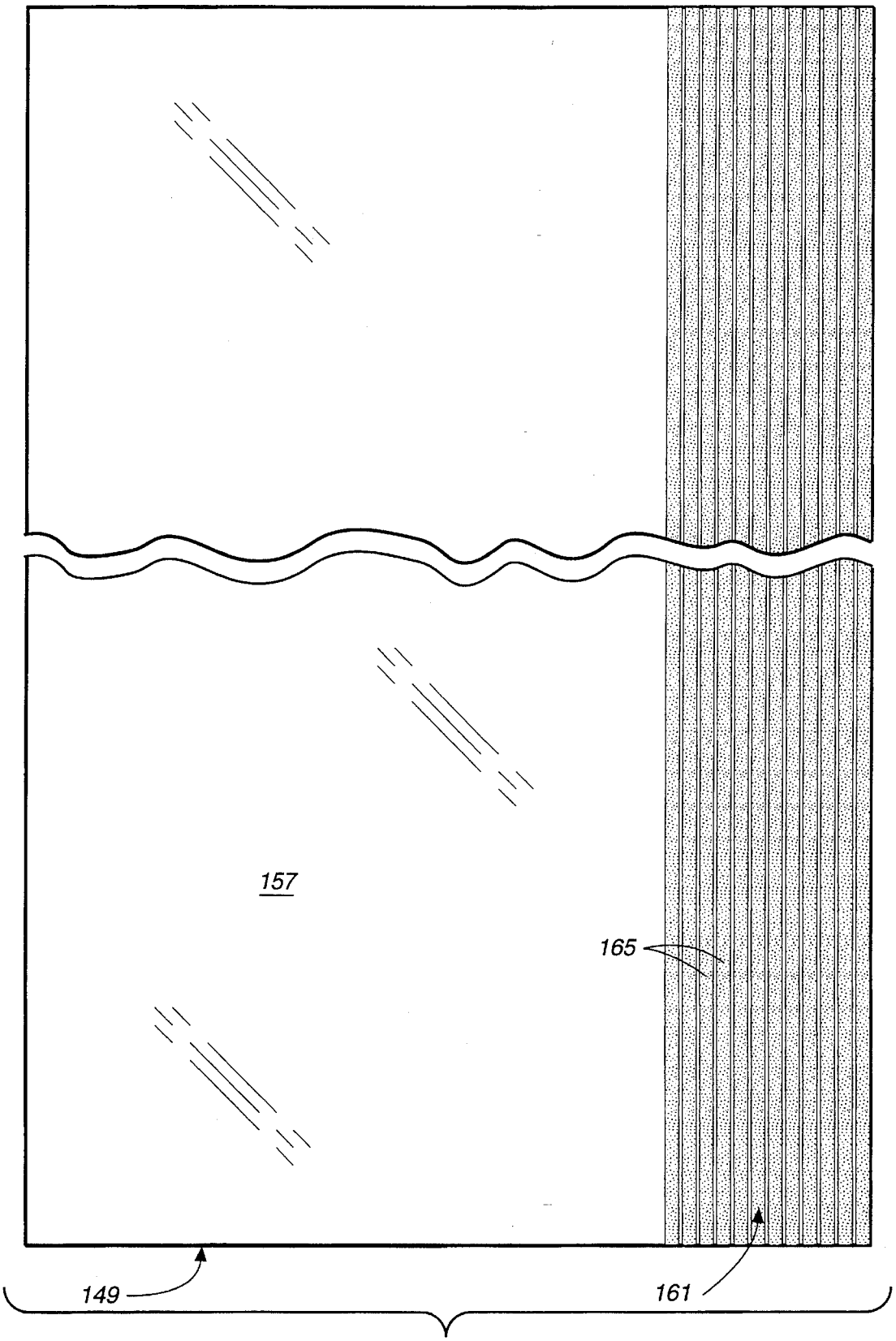
FIG. 9 is a top plan view of the lens element of the task light shown in FIG. 7.

A suitable prismatic design for the prismatic surface 163 of the edge lens segment is illustrated in FIGS. 7 and 8. For a lens element in which the width of the planar lens portion from its distal edge to its proximal edge is 4.622 inches which has a downwardly curved edge lens segment lying on a radius of curvature of 4.437 inches centered 3.658 inches above the planar lens portion and 6.952 inches from the distal edge of the planar lens portion, suitable prism angles for prisms 1 through 20 on the edge lens segment are set forth in the table shown in FIG. 7. Again, the above dimensional characteristics of suitable lens design are illustrative only.

It is noted that when-the lens element illustrated in FIG. 7 is set in the housing over the bottom light passage opening as shown in FIG. 6, the planar lens portion 157 is inclined slightly upwardly such that this lens portion faces somewhat toward the front of the task light. The curved edge lens segment 161, on the other hand, extends downwardly from the proximal edge 169 of the planar lens portion to engage the front bottom wall extension 153 of the housing, and faces to the rear of the task light past the planar lens portion. This lens structure advantageously permits the two lens portions to efficiently work in concert to provide a suitably uniform distribution of light throughout the task area.

The function of the optical elements of the lensed version of the task light of the invention can further be explained in reference to the light ray traces X, Y, Z shown in FIG. 6. Ray trace X illustrates a light trace emitted from the light source 141 in the direction of the first reflector portion 143. Since the first reflector portion is a diffuse deflector, the light striking this portion of the reflector will be dispersed as generally indicated by the multi-directional dispersion arrows 144. As the diffused light is then projected on to the planar lens portion 157 of the subjacent reflector element, the light is again dispersed in a dispersion pattern that is generally biased toward the rear of the task light as indicated by multi-directional dispersion arrows 146. Similarly, light reflected from the masking stripes of edge lens segment 161 can be dispersed through the planar lens portion 157 from a dispersive reflection off of the first reflector portion as indicated by ray trace Y.

The contribution of the edge lens segment is generally illustrated by ray trace Z wherein the light ray is transmitted between masking stripes through the edge lens segment so as to be refracted by the active surface of one of the directive prisms of the edge lens segment.

For the task light of the invention to uniformly illuminate the task surface (and to some lesser extent the vertical backwall surface) of a task area, the contributions of the surrounding ambient lighting must be taken into account. Thus, the distribution of light from the lens element 149 preferably decreases toward the front of the task area as the ambient lighting takes over. In accordance with the method of the invention, the distribution of light from the task light is controlled such that, with light contributions from ambient lighting in the vicinity of the task area, the illumination within the task area, and on the task surface and vertical backwall surface of the task area, is substantially uniform from the front to the rear of the task area. Such a uniformity illuminated task area is, in turn, preferably produced by a task light in which the only optical element that presents itself to the task area is a uniform, low brightness element thereby eliminating a source of reflected glare.

Figure 10:
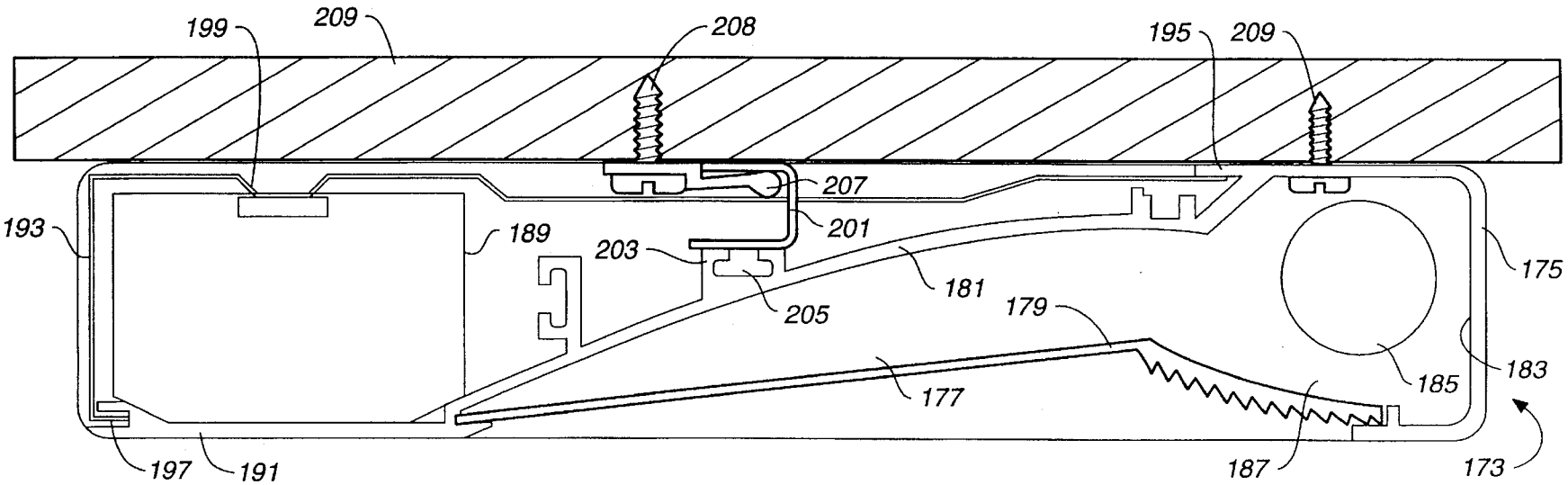
FIG. 10 is a side elevational view in cross-section of an alternative embodiment of the lensed version of the invention showing an integral reflector and housing construction and means for mounting the task light to an overhead panel structure.

FIG. 10 illustrates an alternative construction of the task light of the invention and a means for mounting the task light to an overhead panel structure. In the FIG. 10 embodiment, the housing and reflector of task light 173 are formed by an extrusion 175 having a unitary construction. The extrusion, which can be cut to any desired length, is capped at both ends by suitable end caps, such as end cap 177. The lens element 179 can similarly be made of a plastic extrusion cut to a length that corresponds with the housing extrusion. Interior extruded walls 176, 183, which form the first reflector portion and second reflector portion of the task light, can suitably be coated with a white enamel paint to provide the desired diffusive reflection characteristics. As in the previously described embodiments, the light source 185 is supported by suitable lamp sockets (not shown) in the front edge cavity portion 187 of the housing extrusion and the ballast 189 is supported on a rear support wall 191 of the extrusion.

The extrusion 175 of the FIG. 10 embodiment is seen to be open at the rear and top. This open portion of the housing is covered by a pliable sheet metal cover 193, the forward edge 195 of which slips under a forward top edge 195 of the extrusion and the rear bottom edge of which snaps into slot 197 at the end of the rear support wall 191. It is seen that a depression 199 in the sheet metal cover contacts the top of the ballast and acts to hold the ballast in place on the extrusion's rear support wall. The removable sheet metal cover 193 facilitates access to the ballast for ballast replacement or repair.

Means for mounting the fixture to the overhead support panel is achieved by means of a U-shaped mounting clip 201 supported on an extruded rib 203 having a T-slot 205 for accommodating the head of an anchoring screw (not shown) for the clip. A corresponding clip engaging clamp 207 is secured by screw 208 to the overhead panel 209 for receiving the projecting end of the mounting clip. A supplementary screw tie down 209 can be suitably provided at the forward end of the extrusion to prevent the task light from becoming dislodged.

Therefore, it can be seen that the present invention provides an improved task light that substantially eliminates sources of reflected glare and that improves the overall lighting environment and visual comfort light within a task area over which the task light is mounted. The task light, in its preferred embodiment, is particularly suitable for task areas having a task surface and a rear backwall surface, however, it is noted that a task light in accordance with the invention can provide task lighting in other task environments. Although the present invention has been described in considerable detail in the foregoing specification, it is understood that it is not intended that the invention be limited to such detail, except as necessitated by the following claims.

What I claim is:

1. An improved task light comprising a housing having a front, rear, top and bottom defining the front, rear, top and bottom of said task light, and further having a center cavity portion, a light passage opening below said center cavity portion, and a front edge cavity portion laterally adjacent said center cavity portion, a light source operatively supported in the front edge cavity portion of said housing for emitting light into the center cavity portion thereof, and a reflector including a first reflector portion extending rearwardly away from said light source and substantially spanning the center cavity portion of said housing, said first reflector portion having a distal edge and a proximal edge in relation to said light source and extending through the center cavity portion of said housing along a path that curves inwardly of said housing such that light from a given light emitting point on said light source strikes the proximal edge of said first reflector portion at an angle of incidence that is not substantially smaller than the angle of incidence of light from the same point on said light source which strikes the distal edge of said first reflector portion.

2. The improved task light of claim 1 wherein the angle of incidence of light from a given point on said light source that strikes said first reflector portion is greatest at the proximal edge of said first reflector portion.

3. The improved task light of claim 1 wherein said first reflector portion is an at least partially diffuse reflector.

4. The task light of claim 3 wherein said first reflector portion is a white diffuse reflector.

5. The improved task light of claim 1 further comprising a second reflector portion disposed in the front edge cavity portion of said housing and extending about said light source for increasing the amount of light directed to said first reflector portion.

6. The improved task light of claim 1 wherein said light source is a fluorescent lamp.

7. An improved task light comprising a housing having a front, rear, top and bottom defining the front, rear, top and bottom of said task light, and further having a center cavity portion, a light passage opening below said center cavity portion, and a front edge cavity portion, adjacent said center cavity portion, said center and front edge cavity portions having a height substantially corresponding to the height of said housing, a light source operatively supported in the edge cavity portion of said housing for emitting light into the center cavity portion thereof, and a reflector including an at least partially diffuse first reflector portion extending rearwardly away from said light source and substantially spanning the center cavity portion of said housing said first reflector portion having a distal edge and a proximal edge in relation to said light source and extending through said center cavity portion along a path that curves inwardly of said housing such that light from a given light emitting point on said light source strikes the proximal edge of said first reflector portion at an angle of incidence that is greater than the angle of incidence of light from the same point on said light source which strikes the distal edge of said first reflector portion, and a second reflector portion disposed in the front edge cavity portion of said housing and extends about said light source for increasing the amount of light directed to said first reflector portion.

8. The improved task light of claim 1 further comprising a light transmissive element substantially covering said light passage opening for receiving light reflected from said first reflector portion.

9. An improved task light comprising a shallow height housing having a front, rear, top and bottom defining the front, rear, top and bottom of said task light, and further having a center cavity portion, a light passage opening below said center cavity portion, and a front edge cavity portion adjacent said center cavity portion, mounting means on the top of said housing for mounting the task light to the underside of a structure overhead a task area, a light source operatively supported in the front edge cavity portion of said housing for emitting light into the center cavity portion thereof and having a rear side facing said center cavity portion, and a reflector including a first reflector portion substantially spanning the center cavity portion of said housing, said first reflector portion having a distal edge and a proximal edge in relation to said light source and lying on a path that extends from the rear of said housing toward the housing's front edge cavity and that, at the proximal edge of said first reflector portion, curves inwardly of said housing to intersect the rear side of said light source.

10. The improved task light of claim 9 wherein said first reflector portion is a white diffuse reflector.

11. An improved task light for providing illumination to a task area having a task surface comprising a housing having a front, rear, top and bottom defining the front, rear, top and bottom of said task light, and further having a center cavity portion, a light passage opening below said center cavity portion, and a front edge cavity portion adjacent said center cavity portion, a light source operatively supported in the front edge cavity portion of said housing for emitting light into the center cavity portion thereof, and a reflector including an at least partially diffuse first reflector portion spanning the center cavity portion of said housing and having a distal edge and a proximal edge in relation to said light source, said first reflector portion extending through said center cavity portion along a path that curves inwardly of said housing such that the luminance of said first reflector portion, when viewed from the level of a task surface illuminated by said task light at any position to the front of the task light, is substantially uniform over the entirety of said first reflector portion by said lens element in a distribution that substantially uniformly illuminates the rear vertical wall surface and back corner region of said task area.

12. An improved task light for providing illumination to a task area having a task surface comprising a housing having a front, rear, top and bottom defining the front, rear, top and bottom of said task light, and further having a center cavity portion, a front edge cavity portion laterally adjacent said center cavity portion, a rear cavity portion and a bottom light passage opening, a light source operatively supported in the front edge cavity portion of said housing for emitting light into the center cavity portion thereof, a reflector including a first reflector portion extending rearwardly away from said light source and substantially spanning the center cavity portion of said housing for reflecting light from said light source through said light passage opening, and a light transmissive element substantially covering said light passage opening and having a bottom presenting surface generally facing a task area to be illuminated, said first reflector portion being formed and positioned relative to said light source to distribute light over at least a portion of said light transmissive element such that the luminance of the bottom presenting surface of said portion of the light transmissive element, when viewed from the level of a task surface illuminated by the task light at any position to the front of the task light, is substantially uniform over the entirety of the presenting surface thereof.

13. The improved task light of claim 12 further comprising a second reflector portion disposed in the front edge cavity portion of said housing and extending about said light source for increasing the amount of light directed to said first reflector portion.

14. The improved task light of claim 12 wherein said light transmissive element comprises a proximal edge relative to said light source, a first light transmissive portion subjacent the first reflector portion of said reflector for receiving light reflected from the first reflector portion of said reflector, and a second light transmissive portion extending along the proximal edge of said light transmissive element for receiving source light directly from the edge cavity portion of said housing.

15. The improved task light of claim 14 wherein the first light transmissive portion of said light transmissive element is a planar lens portion having a light dispersing prismatic surface.

16. The improved task light of claim 14 wherein the second light transmissive portion of said light transmissive element is an edge lens segment extending along the proximal edge of said light transmissive element and having a light directing prismatic surface for directing source light received by said edge lens segment into a predetermined region below said task light.

17. The improved task light of claim 14 wherein the second light transmissive portion of said light transmissive element includes an interior surface portion and intermittent masked areas on said interior surface portion for limiting the amount of source light transmitted therethrough.

18. The improved task light of claim 17 wherein the intermittent masked areas are opaque and reflect light such that a portion of the source light incident on the second light transmissive portion of said light transmissive element is reflected back into said housing thereby increasing the available light received and reflected by the first reflector portion of said reflector.

19. The improved task light of claim 18 wherein said intermittent masked areas consist of masking stripes extending longitudinally of the second light transmissive portion of said light transmissive element.

20. The improved task light of claim 14 wherein the first light transmissive portion of said light transmissive element is a planar lens portion having a light dispersing prismatic surface, and said second light transmissive portion is a edge lens segment extending along the proximal edge of said light transmissive element and having a light directing prismatic surface for directing light received by said lens segment into desired regions below said task light.

21. The improved task light of claim 20 wherein said edge lens segment has a bottom presenting surface and extends laterally and downwardly from said planar lens portion such that the bottom presenting surface thereof faces rearwardly of said task light.

22. An improved task light for providing illumination to a task area having a task surface comprising a housing having a front, rear, top and bottom defining the front, rear, top and bottom of said task light, and further having a center cavity portion, a front edge cavity portion, and a bottom light passage opening, a light source operatively supported in the front edge cavity portion of said housing for emitting light into the center cavity portion thereof, and a reflector including a first reflector portion spanning the center cavity portion of said housing for reflecting light from said light source through said bottom light passage opening, and a lens element covering said light passage opening and having a proximal edge and distal edge in relation to said light source, said lens element including a planar lens portion having a light dispersing prismatic surface and an edge lens segment, said edge lens portion extending along the proximal edge of said lens element and having a light directing prismatic surface for directing light received thereby from said light source into desired regions below said task light, the planar lens portion and edge lens segment of said lens element each having a bottom presenting surface generally facing a task area to be illuminated, said first reflector portion being formed and positioned relative to said light source to distribute light over the planar lens portion of said lens element such that the luminance of the bottom presenting surface of said planar lens portion, when viewed from the level of a task surface illuminated by the task light at any position to the front of the task light, is substantially uniform over the entirety of the presenting surface thereof, and said edge lens segment having intermittent masked areas for limiting the amount of source light transmitted therethrough such that the luminance of the bottom presenting surface of said edge lens segment, when viewed from the level of a task surface illuminated by the task light at any position to the front of the task light, is not substantially greater than the luminance of the presenting surface of the planar lens portion of said lens element.

23. The improved task light of claim 22 wherein said edge lens segment has an exterior surface and an interior surface, said light directing prismatic surface is on the exterior surface thereof, and said masked areas are on the interior surface thereof.

24. The improved task light of claim 23 wherein said masked areas are opaque and reflect light such that a portion of the source light incident on the second light transmitting portion of said light transmissive element is reflected back into said housing thereby increasing the available light received and reflected by the first reflector portion of said reflector.

25. The improved task light of claim 24 wherein the edge lens segment of said lens element extends laterally and downwardly from said planar lens portion such that the bottom presenting surface thereof faces rearwardly of said task light.

26. The improved task light of claim 25 wherein the planar lens portion of said lens element lies in a plane that is upwardly inclined toward the proximal edge of said lens element such that the presenting surface of said planar lens portion faces toward the front of said task light.

27. The improved task light of claim 22 wherein the light dispersing prismatic surface of the planar lens portion of said lens element is a bottom linear prismatic surface having linear prisms distributed over said planar lens portion from the side of the proximal edge toward the side of distal edge of said lens element.

28. The improved lens element of claim 27 wherein the linear prisms of said planar lens portion are substantially isosceles prisms having an apex angle that increases from the side of the proximal edge toward the side of the distal edge of said lens element.

29. The improved lens element of claim 28 wherein the apex angle of the linear prisms of said planar lens portion increases from approximately 90 degrees from the side of the proximal edge of said lens in one degree increments.

30. An improved task light for providing illumination to a task area having a task surface comprising a shallow height housing having a front, rear, top and bottom defining the front, rear, top and bottom of said task light, and further having a center cavity portion, a front edge cavity portion, a rear edge cavity portion, and a bottom light passage opening, mounting means on the top of said housing for mounting the task light to the underside of a structure overhead said task area, a light source operatively supported in the front edge cavity portion of said housing for emitting light into the center cavity portion thereof, a ballast in said rear cavity portion, a reflector including a first at least partially diffuse reflector portion spanning the center cavity portion of said housing for reflecting light from said fluorescent lamp through said bottom light passage opening, and a lens element covering said light passage opening and having a proximal edge and distal edge in relation to said fluorescent lamp, said lens element including a planar lens portion having a light dispersing prismatic surface and an edge lens segment, said edge lens segment extending along the proximal edge of said lens element and having a light directing prismatic surface for directing light received thereby into desired regions and below said task light, the planar lens portion and edge lens segment of said lens element each having a bottom presenting surface generally facing a task area to be illuminated, said first reflector portion being formed and positioned relative to said light source to distribute light over the planar lens portion of said lens element such that the luminance of the bottom presenting surface of said planar lens portion, when viewed from the level of a task surface illuminated by the task light at any position to the front of the task light, is substantially uniform over the entirety of the presenting surface thereof, and said edge lens segment having intermittent masked areas for limiting the amount of source light transmitted therethrough such that the luminance of the bottom presenting surface of said edge lens segment, when viewed from the level of a task surface illuminated by the task light at any position to the front of the task light, is not substantially greater than the luminance of the presenting surface of the planar lens portion of said lens element.

31. An improved task light for providing illumination to a task area having a task surface comprising a light source, and optical means including a reflector having a reflector surface which extends edgewise away from said light source and which operatively faces said task surface for distributing light from said light source to said task area, said reflector surface being so formed and positioned with respect to the light source that the luminance thereof, when viewed from the level of the task surface illuminated thereby at any position to the front of the task light, is substantially uniform over the entirety of said reflector surface.

32. The improved task light of claim 31 wherein said reflector surface is operatively a low luminance surface.

33. The improved task light of claim 32 wherein the operative luminance of said bottom presenting surface is no greater than approximately 250 footlamberts.

34. An improved task light for providing illumination to a task area from a task light mounting surface above the task area, said task area having a defined front and rear and being bounded by a vertical rear wall surface and a task surface that intersect at a back corner region at the rear of said task area, said task light comprising a light source, and optical means including a reflector and a lens element below said reflector such that source light reflected from said reflector passes through said lens element, said reflector being so formed and positioned with respect to the light source that the operative luminance thereof is substantially uniform when viewed from the direction of the front of the task surface, and said lens element being so formed that source light is distributed throughout said task area by said lens element in a distribution that substantially uniformly illuminates the rear vertical wall surface and back corner region of said task area.

35. The improved task light of claim 34 wherein said lens element has a proximal edge and distal edge in relation to said light source, and includes a planar lens portion having a light dispersing prismatic surface and an edge lens segment, said edge lens segment extending along the proximal edge of said lens element and having a light directing prismatic surface for directing light received thereby at the back corner region of said task area.

36. A method for providing light from a reflector surface to a task area bounded by a task surface, an overhead mounting structure, and a vertical backwall surface, said method comprised of the steps of providing ambient lighting in the vicinity of said task area which provides some general lighting to the task area, providing light to the task area from a task light mounted to the overhead mounting structure for further illuminating said task area, said task light having a reflector surface, controlling the distribution of the light from the task light such that, including contributions of ambient light from the vicinity of said task area, the illumination within said task area and on the task surface and vertical backwall surface bordering same is substantially uniform from the front to the rear of said task area, and controlling the brightness of the reflector surface of the task light such that the reflector surface exhibits substantially uniform luminance for reducing reflected glare within said work area observable to a person positioned in front of the task area.

37. The method of claim 36 wherein the luminance of the reflector surface of said task light, when viewed from the direction of the task surface to the front of said task area, does not exceed approximately 250 footlamberts.

* * * * *

UNITED STATES PATENT AND TRADEMARK OFFICE

CERTIFICATE OF CORRECTION

PATENT NO. : 5,530,628

DATED : June 25, 1996

INVENTOR(S) : Peter Y.Y. Ngai

It is certified that error appears in the above—identified patent and that said Letters Patent is hereby corrected as shown below:

Claim 7, Col. 14, line 64, insert —,— after housing.

Claim 11, Col. 15, lines 60-63, after "first reflector portion", delete the remainder of the sentence.

Signed and Sealed this

Twenty-second Day of October, 1996

*Attest:*

Bruce Lehman

BRUCE LEHMAN

*Attesting Officer*

*Commissioner of Patents and Trademarks*